US012428798B2

(12) United States Patent
Haas

(10) Patent No.: US 12,428,798 B2
(45) Date of Patent: Sep. 30, 2025

(54) MAST ELEMENT, IN PARTICULAR LEADER ELEMENT, FOR A CONSTRUCTION MACHINE

(71) Applicant: BAUER Maschinen GmbH, Schrobenhausen (DE)

(72) Inventor: Josef Haas, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 8 days.

(21) Appl. No.: 18/556,059

(22) PCT Filed: Apr. 28, 2022

(86) PCT No.: PCT/EP2022/061338
§ 371 (c)(1),
(2) Date: Oct. 18, 2023

(87) PCT Pub. No.: WO2022/243002
PCT Pub. Date: Nov. 24, 2022

(65) Prior Publication Data

US 2024/0209587 A1 Jun. 27, 2024

(30) Foreign Application Priority Data

May 19, 2021 (EP) ..... 21174782

(51) Int. Cl.
*E02D 13/04* (2006.01)
*E02D 7/16* (2006.01)
*E02D 11/00* (2006.01)

(52) U.S. Cl.
CPC ..... *E02D 13/04* (2013.01); *E02D 7/165* (2013.01); *E02D 11/00* (2013.01)

(58) Field of Classification Search
CPC ..... E02D 7/16; E02D 11/00; E02D 13/04; E02D 7/165; E21B 15/00
See application file for complete search history.

(56) References Cited

U.S. PATENT DOCUMENTS 8,632,275 B2 * 1/2014 Chagnot ..... E02D 7/16 173/39
8,661,743 B2 * 3/2014 Flusche ..... E21B 19/165 173/28

(Continued)

FOREIGN PATENT DOCUMENTS

CN 85108187 A * 4/1986 ..... E02D 11/00
CN 204457452 U * 7/2015

(Continued)

OTHER PUBLICATIONS

International Preliminary Report on Patentability (Chapter I) and Written Opinion of the International Searching Authority issued in PCT/EP2022/061338; issued Nov. 21, 2023.

(Continued)

*Primary Examiner* — Frederick L Lagman
(74) *Attorney, Agent, or Firm* — Studebaker Brackett PLLC

(57) ABSTRACT

The invention relates to a mast element, in particular a leader element, for a construction machine, with an elongate hollow mast profile which, at a front side, is provided along a mast longitudinal direction with two guide strips through which a linear guide for a mast carriage is formed along the front side. According to the invention, provision is made that at least one guide strip is designed as part of a guide profile on which at least one connection web is formed in one piece with the guide strip, which connection web extends away from the guide strip, and that, in order to form the hollow mast profile, elongate wall elements are provided which, together with the at least one connection web, form the hollow mast profile and enclose an inner cavity of the mast profile.

10 Claims, 2 Drawing Sheets

(56) References Cited

U.S. PATENT DOCUMENTS

Figure 1:
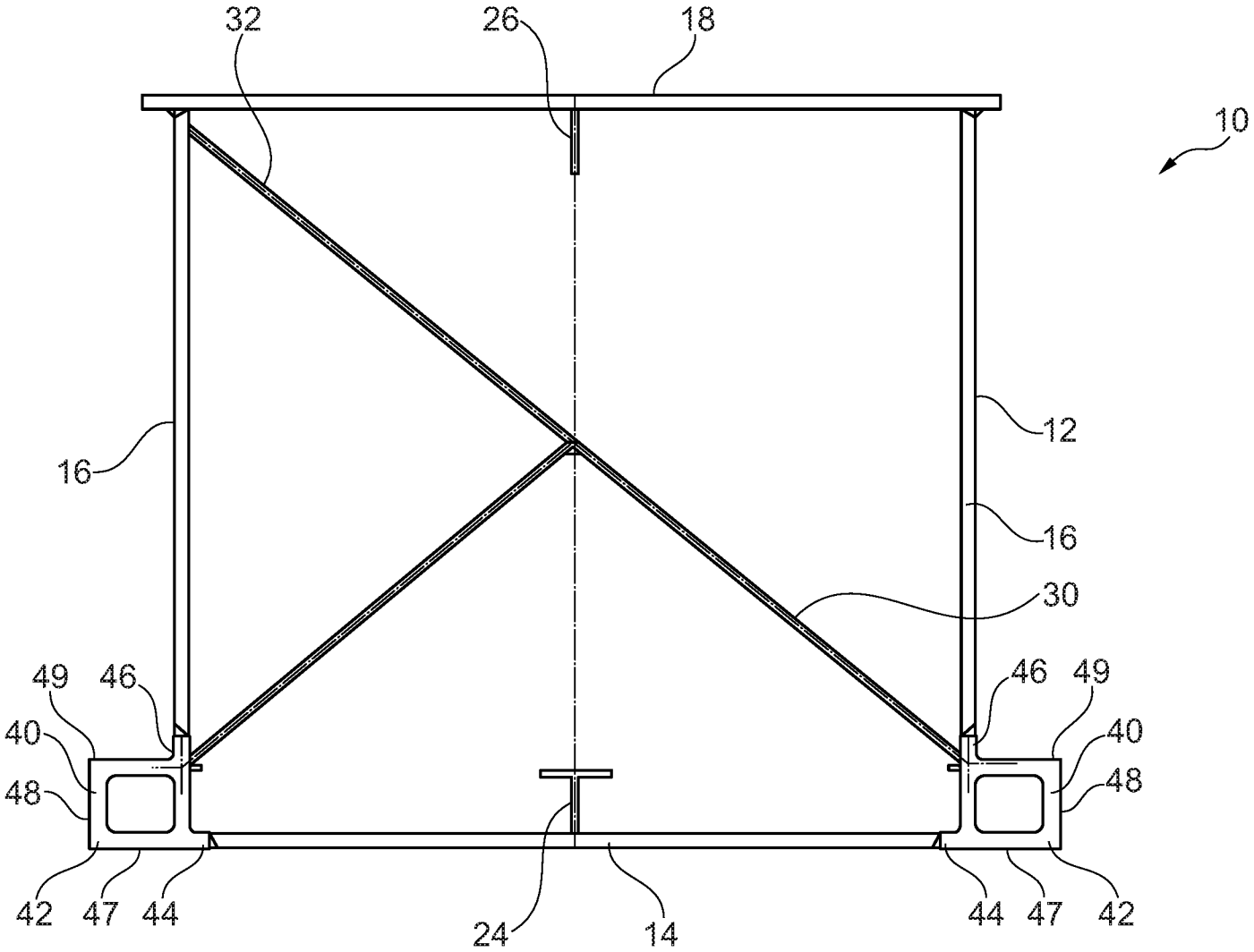

| | | | | |
|---|---|---|---|---|
| 10,167,685 | B2 * | 1/2019 | Schober | E02D 11/00 |
| 2020/0283981 | A1 * | 9/2020 | Shevtsov | E02D 7/08 |

FOREIGN PATENT DOCUMENTS

| | | | | | |
|---|---|---|---|---|---|
| CN | 106285496 | A | * | 1/2017 | |
| CN | 206409192 | U | * | 8/2017 | |
| CN | 110485919 | A | * | 11/2019 | E02F 5/02 |
| DE | 2942116 | A1 | * | 4/1981 | |
| EP | 2584097 | A1 | | 4/2013 | |
| EP | 2520756 | B1 | | 7/2013 | |
| KR | 20160010047 | A | * | 1/2016 | |
| WO | 2017174863 | A1 | | 10/2017 | |

OTHER PUBLICATIONS

International Search Report issued in PCT/EP2022/061338; mailed Aug. 10, 2022.

* cited by examiner

MAST ELEMENT, IN PARTICULAR LEADER ELEMENT, FOR A CONSTRUCTION MACHINE

The invention relates to a mast element, in particular a leader element, for a construction machine with an elongate hollow mast profile which, on a front side along a longitudinal direction of the mast, is provided with two guide strips, by which a linear guide for a mast carriage is formed along the front side, in accordance with the preamble of claim 1.

Mast elements of such type are in particular known as masts for earth drilling apparatuses which are employed for the production of foundation piles for example. Such mast elements, which are substantially vertically aligned in operation, typically have a length of a few meters up to approximately 30 meters. Along a front side of the mast element, which is frequently also referred to as leader, a linear guide for a mast or work carriage is provided. On this work carriage a drill drive for an earth drilling apparatus can be arranged for example.

The mast elements must have a high degree of stiffness along with a minimum possible weight so as to ensure reliable guidance on the one hand and on the other hand keep the center of gravity of the entire apparatus low for good tilt stability. It is known that for such mast elements an approximately rectangular hollow profile is used. Such a tubular hollow profile can be manufactured as a seamless hollow profile from a steel material.

To form the longitudinal guide it is known that the two guide strips, which are rectangular in cross section and have the guide surfaces designed thereon, are welded laterally onto the hollow mast profile. This can lead to distortion or a deterioration of the directly adjoining guide surfaces. Moreover, a welded seam is carried out directly on a corner edge of the hollow mast profile which is subject to a high load during operation. The welding in a load-exposed region can have an unfavorable effect on the strength and durability of the connection as well as the resistance to corrosion.

From EP 2 520 756 B1 a mast element with an elongate tubular body is known which is formed of a fiber reinforced material. The fixing of the guide strips on this mast element takes place by way of bracket-like holders. The processing of fiber reinforced materials is time-consuming and costly. A connection with steel materials proves to be difficult and requires specific types of connection.

The invention is based on the object to provide a mast element, for which an efficient arrangement of a linear guide is given.

According to the invention the object is achieved by a mast element having the features of claim 1. Preferred embodiments of the invention are stated in the dependent claims.

The mast element according to the invention is characterized in that at least one guide strip is designed as part of a guide profile, on which, formed in one piece with the guide strip, at least one connecting web is designed that extends away from the guide strip, and in that in order to form the hollow mast profile elongate wall elements are provided which, together with the at least one connecting web, form the hollow mast profile and enclose an inner hollow space of the mast profile.

A basic idea of the invention resides in the fact that no conventional rectangular guide strip but a guide profile is provided which encompasses the preferably plate-shaped or rectangular guide strip and on which at least one connecting web is additionally designed in one piece that extends away from the guide strip. The connecting web can be used for welding with an adjoining elongate wall element of the mast profile. The wall elements can be plates and/or angle profiles. The guide strip can have one or several guide surfaces. The at least one connecting web can extend away from the guide strip to such an extent that it reaches into the next corner region and forms a side wall of the mast profile. On the corners without guide strips use can also be made of angle profiles which each extend up to the connecting webs or the opposite angle profile so that the mast profile only consists of profiles or additional elongate wall elements are only present on one, two or three sides.

By relocating the welded seam away from the guide strip and away from a guide region a particularly stable connection of the guide strip can be achieved. Due to this arrangement the welded seam can be relocated to a plane wall region that is less load-exposed and spaced apart considerably from the corner region. As a result, a particularly stable connection is achieved. Moreover, the structure in the region of the welded seam is exposed to less mechanical tension, whereby the corrosion behavior is also improved in this region. Finally, spacing apart the welded seam as a place of heat input reduces the risk of heat distortion on the guide strip during welding. This can prevent laborious reworking. A preferred embodiment of the invention resides in the fact that the connecting web can form a part of the hollow mast profile. Together with the at least one connecting web the elongate wall elements for the mast profile form the hollow mast profile and enclose an inner hollow space of the mast profile. As a result, a particularly light construction can be reached.

An advantageous embodiment of the invention resides in the fact that the wall elements and the at least one connecting web are connected, in particular welded to each other in the longitudinal direction of the mast. Generally, the connection can also be implemented through screwing which is in particular rendered possible by the connecting webs. Especially good producibility results from the fact that the connecting web is welded to the adjoining wall element. The welded seam can run in the longitudinal direction of the mast which proves to be favorable with regard to the load of a vertical mast.

According to a further development of the invention it is particularly expedient that the mast profile has two guide profiles. The guide profiles are arranged parallel to each other and are connected to each other via the front wall element. In this way, a symmetrical load can be achieved which is favorable from the viewpoint of strength.

Basically, the guide profile can be produced as a solid profile. Regarding a generally desired weight reduction in vertical masts it is advantageous in accordance with an embodiment variant of the invention that the guide profile is formed as a hollow profile from a metal material, in particular from steel. The guide profile can in particular be extruded as a hollow profile. Through the design as a hollow profile particularly good heat dissipation can be reached during welding, whereby the risk of distortion of the guide strip during welding can be reduced.

Basically, different profile shapes can be provided for the two opposite sides. According to a further development of the invention particularly favorable producibility can be achieved in that each guide strip is designed as part of a guide profile which are preferably of the same shape. For installation on the opposite sides the respective guide strips need merely be installed in a rotated manner.

According to a further development of the invention it is advantageous that inside the hollow mast profile a reinforcing element for stiffening the hollow mast profile is arranged. This increases the stability.

According to another embodiment of the invention particularly good stiffening is achieved in that inside the mast profile at least one diagonal reinforcing element extends along the longitudinal direction of the mast, the said reinforcing element being arranged at an oblique angle to the sides of the approximately rectangular mast profile. The oblique angle deviates from a right angle. The reinforcing element runs in the longitudinal direction of the mast at least across one or several partial regions, preferably over the entire length of the mast element. By way of such an inner diagonal stiffening a considerable increase in the torsional stiffness of the mast profile can be achieved whilst having relatively little additional weight.

Basically, the reinforcing element can be connected in any suitable way to the outer mast profile, for instance by being screwed together. A preferred embodiment of the invention resides in the fact that the at least one reinforcing element is welded along an internal side of the mast profile. Welding constitutes a reliable and cost-efficient connection between steel materials. The welded seam runs in this case along the longitudinal direction of the mast.

According to a further development of the invention it is especially advantageous that the at least one reinforcing element is fixed, in particular welded to at least one guide profile. By preference, the reinforcing element is welded along two guide profiles. The reinforcing element, which can also be referred to as stiffening element, can be of angular design and preferably extend from one corner region to an opposite corner region. In principle, two or more reinforcing elements can also be provided inside the mast profile.

According to a further embodiment variant of the invention a particularly efficient stiffening can be achieved in that the at least one reinforcing element has a plate-shaped metal sheet or a folded metal sheet. Such reinforcing elements can be produced at low cost. By way of a folded metal sheet, which can be of L-shape, C-shape or Z-shape in cross section, an additional increase in torsional stiffness is achieved as compared to a plane sheet plate.

According to a further development of the invention a particularly high degree of stiffening is in particular reached in that several reinforcing elements are welded along the internal side of the mast. The several reinforcing elements can be arranged and welded by being offset in the axial longitudinal direction as well as located directly next to each other inside the mast profile. On their butt joints the reinforcing elements can also be welded to each other.

Basically, the reinforcing element can be a continuous plate element. An especially preferred embodiment of the invention resides in the fact that the at least one reinforcing element has recesses for weight reduction. These recesses can for example be notches in the shape of a circular disk located in center regions of the plate-shaped reinforcing element. As a result, a considerable weight reduction of the reinforcing element along with continued good stiffness can be achieved.

Basically, the mast element according to the invention can be employed or attached on its own or in combination with further mast elements on various types of apparatuses and rigs. In particular, the invention comprises a construction machine, more particularly a foundation engineering machine, with a carrier implement and a mast mounted thereon, wherein the mast has at least one mast element according to the invention.

Especially in the case of construction machines with mobile carrier implements a mast of particular stiffness is required, while at the same time on account of the mast the overall center of gravity of the construction machine should not be relocated too far in the upward direction in order to ensure sufficient stability and tilt resistance of the construction machine. This can be achieved particularly well with the mast element according to the invention.

According to a further development it is especially advantageous that the mast is designed as a leader, in particular a telescopic leader. A leader basically constitutes a vertical mast with at least one linear guide, especially for a work carriage. In the case of a telescopic leader a second mast element is guided in a linearly displaceable manner along the linear guide of a first mast element. On the second mast element a linear guide can also be arranged for the work carriage. Through a telescopic leader thus formed the two mast elements can be moved telescopically with respect to each other so that in operation a relatively high overall mast can be realized.

It is particularly preferred that the mast profile is composed, in particular welded together of two or more elongate mast parts that each extend over the length of the mast element. The mast elements can be elongate sheet metal plates or sheet metal profiles. At least before welding the final mast part to enclose the hollow mast profile the at least one reinforcing element is inserted and preferably welded in the longitudinal direction to the internal sides of the still open mast profile. This can be carried out in a simple and efficient way. Subsequently, the mast profile can be mounted, more particularly welded over side to form the closed hollow mast profile.

Figure 2:
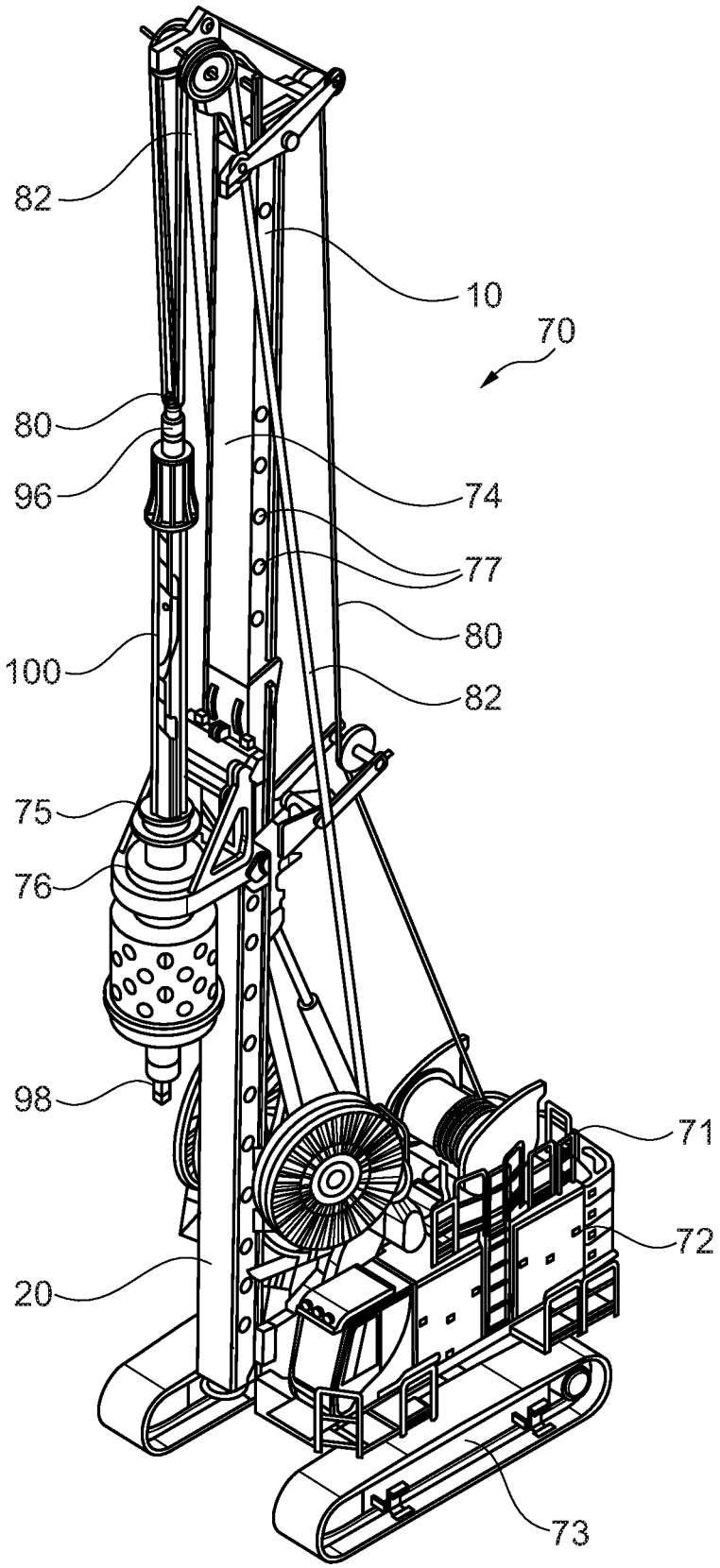

The invention is described further hereinafter by way of preferred embodiments illustrated in the drawings, wherein show:

FIG. 1 a schematic cross-sectional view of a mast element according to the invention; and FIG. 2 a perspective view of a construction machine according to the invention.

FIG. 1 shows a schematic cross sectional view of a mast element 10 according to the invention which is substantially formed by an outer hollow mast profile 12. The mast profile 12 can be composed of and welded from different mast parts or walls that run in a longitudinal direction of the mast. The longitudinal direction of the mast extends perpendicularly to the drawing plane.

As mast parts the mast profile 12 has a front wall element 14, two side wall elements 16 and a rear wall element 18 which are welded to each other to form the mast profile 12 that is rectangular in cross section. In the corner regions between the side wall elements 16 and the front wall element 14 two laterally projecting hollow guide profiles 40 having an integrated hollow guide strip 42 each are inserted and welded on that are provided along a front side to form a linear guide 20 for a non-depicted mast or work carriage. The guide strips 42 each have front guide surfaces 47, lateral guide surfaces 48 and rear guide surfaces 49.

For welding-on the guide profiles 20 each have two connecting webs 44, 46 which extend away from the central hollow guide strip 42. The first connecting web 44 extends towards the front wall element 14 and is welded thereto. The second connecting web 46 runs rectangularly to the first connecting web 44 towards the adjoining side wall element 16 and is welded thereto. Thus, the guide strips 42 are located in the corners of the mast profile 12 while the welded seams are spaced apart from the corners.

To stiffen the mast element 10 a first reinforcing element 30 and a second reinforcing element 32 are arranged in the hollow space 13 of the hollow mast profile 12 and welded to the internal sides of the outer mast profile 12. The diagonal first reinforcing element 30 is an approximately rectangularly folded equal-sided sheet metal which is welded on its free ends to the guide profiles 40 lying opposite in each case. The sides of the folded first reinforcing element 30 are arranged at an angle of approximately 45° with respect to the side walls 16, with an edge region lying approximately in the center of the mast profile 12.

The diagonal second reinforcing element 32 is on the one hand fixed on the left side wall element 16 in a corner region thereof and on the other hand welded approximately in the center of the mast profile 12 to the first reinforcing element 30 in the edge region thereof. Due to this multiple diagonal stiffening running in the longitudinal direction of the mast a particularly high stiffness of the hollow mast profile 12 and thus of the mast element 10 is achieved. The reinforcing elements 30, 32 forming individual compartments in the mast profile 12 can also be referred to as longitudinal mast bulkheads.

In addition, on the internal sides of the individual mast parts additional longitudinal profiles can be welded parallelly or rectangularly to the internal sides for the purpose of stiffening, for instance a first longitudinal profile 24 on the internal side of the front wall 14 and a second longitudinal profile 26 on an internal side of the rear wall 18 which increase, inter alia, the stiffness of the front wall 14 and the rear wall 18 against buckling.

According to FIG. 2 a construction machine 70 according to the invention with a carrier implement 71 is illustrated. The carrier implement 71 comprises an upper carriage 72 that is rotatably supported on an undercarriage 73 that has a crawler-track running gear.

On the upper carriage 72 a substantially vertically directed mast 74 is supported that comprises a mast element 10 according to the invention. Along the mast 74 with the mast element 10 a linear guide 20 for a mast carriage 75 is designed. On the mast carriage 75 a rotary drive 76 can be supported. Via a supporting rope 80 guided across a mast head of the mast 74 a Kelly bar arrangement 100 can be suspended that protrudes downwards through the annular rotary drive 76. On a lower end of the Kelly bar arrangement 100 a non-depicted drilling tool, such as a drilling bucket, can be mounted on a tool connection 98. Via at least one feed line 82 e.g. hydraulic fluid can be fed from the carrier implement 71 via a suspension means 96 to the Kelly bar arrangement 100 and thus to a suspended drilling tool.

Along the mast 74 access holes 77 are indicated which, as is generally known, are required for welding on transversely directed bulkhead plates.

The invention claimed is:

1. A mast element for a construction machine with an elongate hollow mast profile which, on a front side along a longitudinal side of the mast element, is provided with a guide strip, by which a linear guide for a mast carriage is formed along the front side, wherein the guide strip is part of a hollow guide profile formed in one piece with the guide strip and having two connecting webs which extend away from the guide strip, wherein in order to form the hollow mast profile, elongate wall elements are provided, wherein each of the two connecting webs is welded to a respective one of the elongate wall elements in the longitudinal direction of the mast to form two welded seams, and wherein the welded seams are arranged away from the guide strip and away from a guide region of the guide strip.

2. The mast element according to claim 1, wherein the mast profile has two guide profiles.

3. The mast element according to claim 1, wherein the guide profile comprises steel.

4. The mast element according to claim 1, comprising a second guide strip which is part of a second guide profile, wherein the guide strip and the second guide strip are the same shape.

5. The mast element according to claim 1, wherein inside the mast profile at least one reinforcing element for stiffening the mast profile is arranged.

6. The mast element according to claim 5, wherein the mast profile is approximately rectangular, and inside the mast profile at least one diagonal reinforcing element extends along the longitudinal direction of the mast, the reinforcing element being arranged at an oblique angle to sides of the approximately rectangular mast profile.

7. The mast element according to claim 5, wherein the at least one reinforcing element is welded along an internal side of the mast profile.

8. The mast element according to claim 1, wherein together with the two connecting webs the elongate wall elements form the hollow mast profile and enclose an inner hollow space of the mast profile.

9. A construction machine, in particular foundation engineering machine, with a carrier implement and a mast mounted thereon, wherein the mast has at least one mast element according to claim 1.

10. The construction machine according to claim 9, wherein the mast is a telescopic leader.

* * * * *